US007654616B2

(12) United States Patent
Kinoshita et al.

(10) Patent No.: US 7,654,616 B2
(45) Date of Patent: Feb. 2, 2010

(54) CHAIR HAVING INTEGRALLY FORMED BACK FRAME AND SEAT FRAME

(75) Inventors: Yojiro Kinoshita, Osaki (JP); Kazutaka Ooki, Osaka (JP); Takeshi Fujiki, Osaka (JP)

(73) Assignee: Kokuyo Furniture Co., Ltd., Osaka-shi (JP)

( * ) Notice: Subject to any disclaimer, the term of this patent is extended or adjusted under 35 U.S.C. 154(b) by 10 days.

(21) Appl. No.: 11/723,592

(22) Filed: Mar. 21, 2007

(65) Prior Publication Data

US 2007/0228799 A1 Oct. 4, 2007

(30) Foreign Application Priority Data

Mar. 28, 2006 (JP) ..... 2006-088777

(51) Int. Cl.
*A47C 7/02* (2006.01)
*A47C 1/12* (2006.01)
*A47C 1/00* (2006.01)

(52) U.S. Cl. ..... 297/452.56; 297/451.11; 297/344.21; 297/452.3

(58) Field of Classification Search ..... 297/452.12, 297/452.11, 452.13, 452.14, 451.11, 451.12, 297/452.56, 451.4, 344.21, 452.63, 452.29, 297/452.31, 452.3, 452.18
See application file for complete search history.

(56) References Cited

U.S. PATENT DOCUMENTS 2,731,078 A * 1/1956 Cadman et al. ..... 297/411.2
3,441,310 A * 4/1969 Gale ..... 297/294
3,756,656 A * 9/1973 Weick ..... 297/451.3
D255,184 S * 6/1980 Locher ..... D6/375
4,361,357 A * 11/1982 Pollock ..... 297/297
4,557,521 A * 12/1985 Lange ..... 297/285
5,088,792 A * 2/1992 Guichon ..... 297/451.12
D341,953 S * 12/1993 Bemis et al. ..... D6/370
D364,748 S * 12/1995 Morin ..... D6/370
D416,700 S * 11/1999 van Rhienen ..... D6/369
D419,325 S * 1/2000 van Rhienen ..... D6/370
D431,922 S * 10/2000 Grosfillex ..... D6/370
6,702,391 B1 * 3/2004 Stipek ..... 297/452.65
6,726,286 B2 * 4/2004 Stumpf et al. ..... 297/452.64

FOREIGN PATENT DOCUMENTS

DE 200 10 342 U1 6/2000

(Continued)

*Primary Examiner*—Milton Nelson, Jr.
(74) *Attorney, Agent, or Firm*—Westerman, Hattori, Daniels & Adrian, LLP

(57) ABSTRACT

The present claimed invention intends to provide a chair having a frame structure that is effective for securing a required strength without needless structure to reinforce the strength.

The chair has a chair body A comprising a seat frame 12, a back frame 22 and a rib that reinforces between the seat frame 12 and the back frame 22, wherein the rib is formed to extend to a side direction so as to be used as an arm frame 71, and the seat frame 12, the back frame 22 and the arm frame 71 are continuously and integrally formed three-dimensionally, and openings 12*a*, 22*a* into which a mesh member 13, 23 to form a seating face is fitted are arranged at the seat frame 12 and the back frame 22 respectively.

10 Claims, 12 Drawing Sheets

FOREIGN PATENT DOCUMENTS

| | | | |
|---|---|---|---|
| EP | 0796577 | A1 | 9/1997 |
| GB | 615796 | | 1/1949 |
| JP | 08-010084 | | 1/1996 |
| JP | 11-266957 | | 10/1999 |
| WO | WO 86/00974 | A1 | 2/1986 |
| WO | WO 96/39899 | A1 | 12/1996 |

* cited by examiner

CHAIR HAVING INTEGRALLY FORMED BACK FRAME AND SEAT FRAME

BACKGROUND OF THE INVENTION AND RELATED ART STATEMENT

This invention relates to a chair preferably used in an office or a home.

As a general structure to constitute a seat and a back for this kind of chair there is a structure wherein a seat is formed with a shell construction to be a seat shell, a back is formed with a shell construction to be a back shell and the seat shell is supported by a seat support and the back shell is supported by a back support rod as described in the patent document 1, or a structure comprising a shell into which the seat and the back are integrally formed as described in the patent document 2.

(Patent document 1) Japan patent laid open number 8-10084

(Patent document 2) Japan patent laid open number 11-266957

A cushion material is mounted on the back or the seat for either of the above-mentioned chairs. In addition, there is a chair having a structure wherein an opening arranged at the seat or the back is covered with a coating cloth such as a mesh member with tension so as to improve a support feeling. In case of adopting this kind of coating cloth, in stead of a shell structure, a frame structure having a back frame or a seat frame provided with an opening is necessary in order to secure a margin for allowing the coating cloth to bow. However, if the arrangement described in the patent document 1 is made with the frame structure having a back frame and a seat frame, the back frame and the seat frame, each of which is separated, have to be connected by the use of a connecting member, resulting in a load concentrating on a joint and the joint is unjointed in a short time. As a result, the chair becomes undurable. Although the arrangement described in the patent document 2 is such that the seat and the back are integrally formed, a load concentrates on a boundary part between the seat and the back, resulting in causing a crack slowly.

An object of the present claimed invention is to provide a chair having a frame structure that is effective for securing a required strength without needless structure to reinforce the strength.

SUMMARY OF THE INVENTION

In order to attain the above object, the present claimed invention takes a following means.

More specifically, a chair of this invention has an arrangement that a chair body comprises a seat frame, a back frame and a rib that reinforces between the seat frame and the back frame, and is characterized by that the rib is formed to extend toward a side direction so as to be used as an arm frame; the seat frame, the back frame and the arm frame are continuously and integrally formed three-dimensionally; and a single opening into which another member to form a seating face is fitted is arranged at a portion ranging from the seat frame to the back frame.

With this arrangement, since the seat frame, the back frame and the arm frame that functions as the rib are integrally formed, a load applied to the chair body can be dispersed and reduced. Especially, with this arrangement of integrally formed, strength can be secured even though each of the seat frame, the back frame and the arm frame is made in a thin shape. In addition, this chair has an arrangement that another member is fitted into the opening ranging from the seat frame to the back frame so as to form the seating face and the opening is covered with tension by another member, strength of the opening is further improved. As a result, deflection is difficult to generate even thought the frames are thin.

As another arrangement of this invention, there is a chair having an arrangement that a chair body comprises a seat frame, a back frame and a rib that reinforces between the seat frame and the back frame, and is characterized by that the rib is formed to extend toward a side direction so as to be used as an arm frame; the seat frame, the back frame and the arm frame are continuously and integrally formed three-dimensionally; and an opening into which another member to form a seating face is fitted is arranged at the seat frame and the back frame respectively.

With this arrangement also, since the seat frame, the back frame and the arm frame are integrally formed, a load applied to the chair body can be dispersed and reduced. Especially, that the opening is formed at the seat frame and the back frame respectively means that a part of the frame locates at a boundary part between the seat and the back. In addition to this arrangement, since the seat frame, the back frame and the arm frame that functions as the rib are integrally formed and each opening is covered with tension, required strength can be easily secured. "Integrally formed" here also includes a case wherein a separated seat frame, a separated back frame and a separated rib are integrally formed in addition to a case wherein whole of the chair is integrally formed.

Furthermore, as a more concrete arrangement of this invention represented is a chair having an arrangement that a width of a valid supporting part locating above a lumbar corresponding part of a back frame is generally the same as a width of a seat frame, a hip corresponding part locating below the lumbar corresponding part of the back frame is gradually narrowed along downward, and a width of a boundary part between a back and a seat is set to be smaller than a width of the valid supporting part of the back frame and a width of the seat frame, a rear end of an arm frame is formed to extend to a front side direction from the back frame, a front end of the arm frame is formed to extend to an upper side direction from the seat frame and whole of the arm frame, the seat frame and the back frame is integrally made of resin, and then a peripheral border of an opening formed by the arm frame, the seat frame and the back frame is curved not two-dimensionally but three-dimensionally.

As mentioned, with this arrangement wherein the arm frame, the seat frame and the back frame are three-dimensionally continuous, a stress can be dispersed effectively. As a result of this, it is possible to effectively secure strength as a structure of the chair as well as an amount of the resin to be used can be reduced as much as possible.

As a concrete structure to reinforce the boundary part between a seat and a back represented is that a boundary part between the seat and the back is of a shape of U-character whose opening faces forward in a longitudinal sectional view, and its longitudinal sectional view forms a continuous three-dimensional shape with curving gently along a hip of a seated person in a plan view.

In addition, as a concrete structure to reinforce the seat represented is that a front hanging part is arranged at a front end of the seat, the front hanging part is of a reverse L-character in a longitudinal sectional view, and its longitudinal sectional view forms a continuous three-dimensional shape with gently curving along a front edge of the seat.

Furthermore, as a concrete structure to reinforce the arm frame represented is that a horizontal part is continuously arranged in a smoothly folded manner at an upper end of the arm frame.

In order to avoid the stress concentrating on a portion between the arm frame and the seat, it is preferable that the arm frame has such a configuration that an end thereof is continuous to an end of the seat frame and extends to a side direction from the seat frame and then smoothly rises upward.

In order to avoid the stress concentrating on a portion between the arm frame and the back, it is preferable that the arm frame has such a configuration that an end thereof is continuous to an end of the back frame and extends to a front side direction from the back frame with forming a smooth curve.

As an appropriate positional relationship between the arm frame and the back frame, it is preferable that one end of the arm frame is connected to the back frame at a height generally the same as a height of a lumbar corresponding part most protruding forward among a back rest supporting face.

In case that another member comprises a mesh member, it is effective that a supporting face having a curved surface that supports the mesh member is arranged at an edge of the opening, and when the mesh member receives a load, the curved surface supports the load through the mesh member with the mesh member smoothly bowing along the curved surface.

As a preferable embodiment of this invention represented is that corner portions of the seat frame are rotatably supported by a leg support post through the multiple seat support frames that extend radially.

Since the present claimed invention has the above-mentioned arrangement, the arm frame that also serves as the rib, the seat frame and the back frame are mutually reinforced each other. As a result, it is possible to provide a superior chair that can produce a required strength effectively although the chair body is of a frame structure.

Since the present claimed invention has the above-mentioned arrangement, the arm frame serving also as the rib, the seat frame and the back frame are integrally formed and reinforce each other. As a result, it is possible to provide a superior chair that can produce a required strength effectively although the chair body is of a frame structure.

DETAILED DESCRIPTION OF THE PREFERRED EMBODIMENTS

One embodiment in accordance with the present claimed invention will be described with reference to the accompanying drawings.

Figure 1:
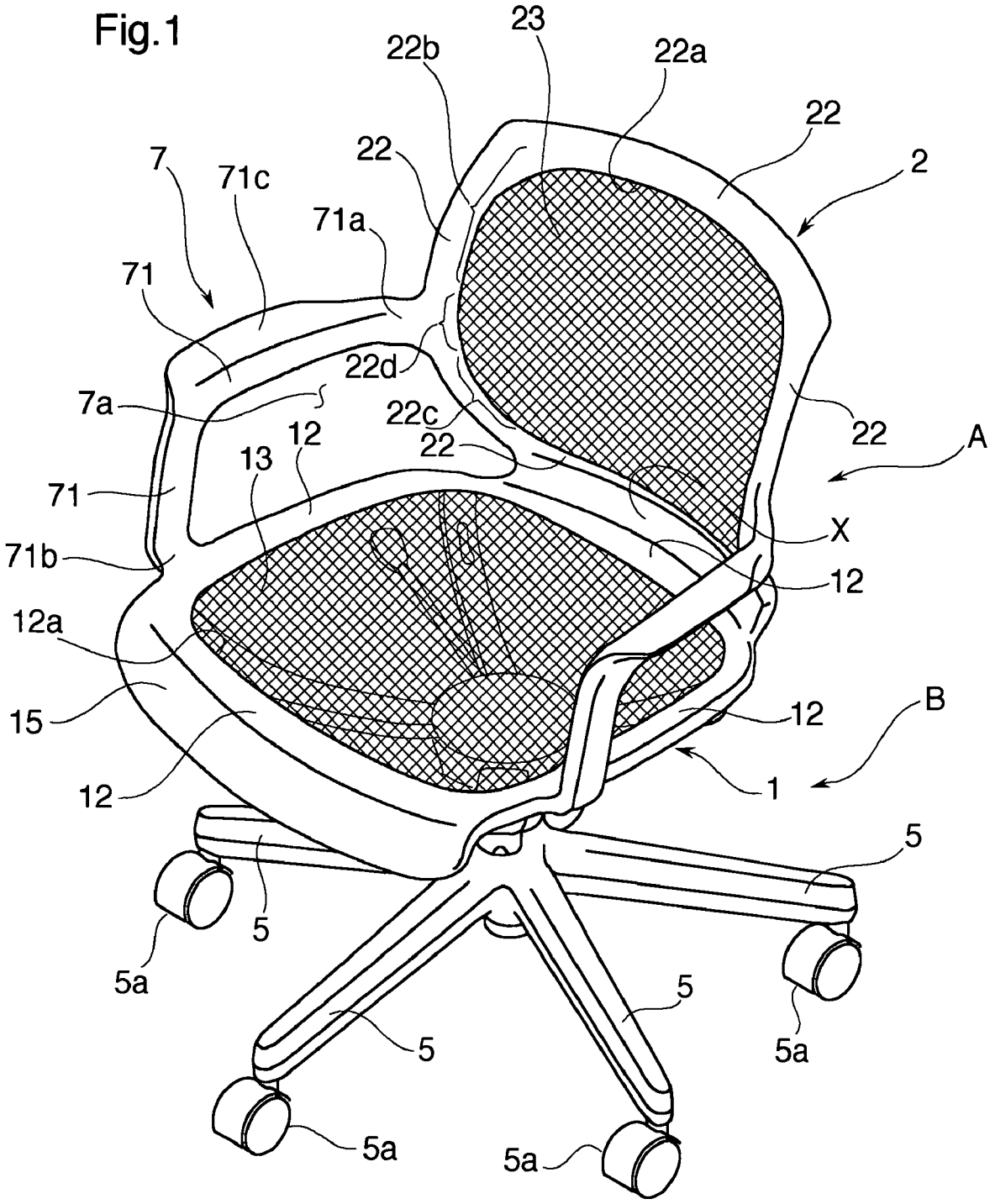
FIG. 1 is a perspective view showing a chair in accordance with one embodiment of this invention.
Figure 2:
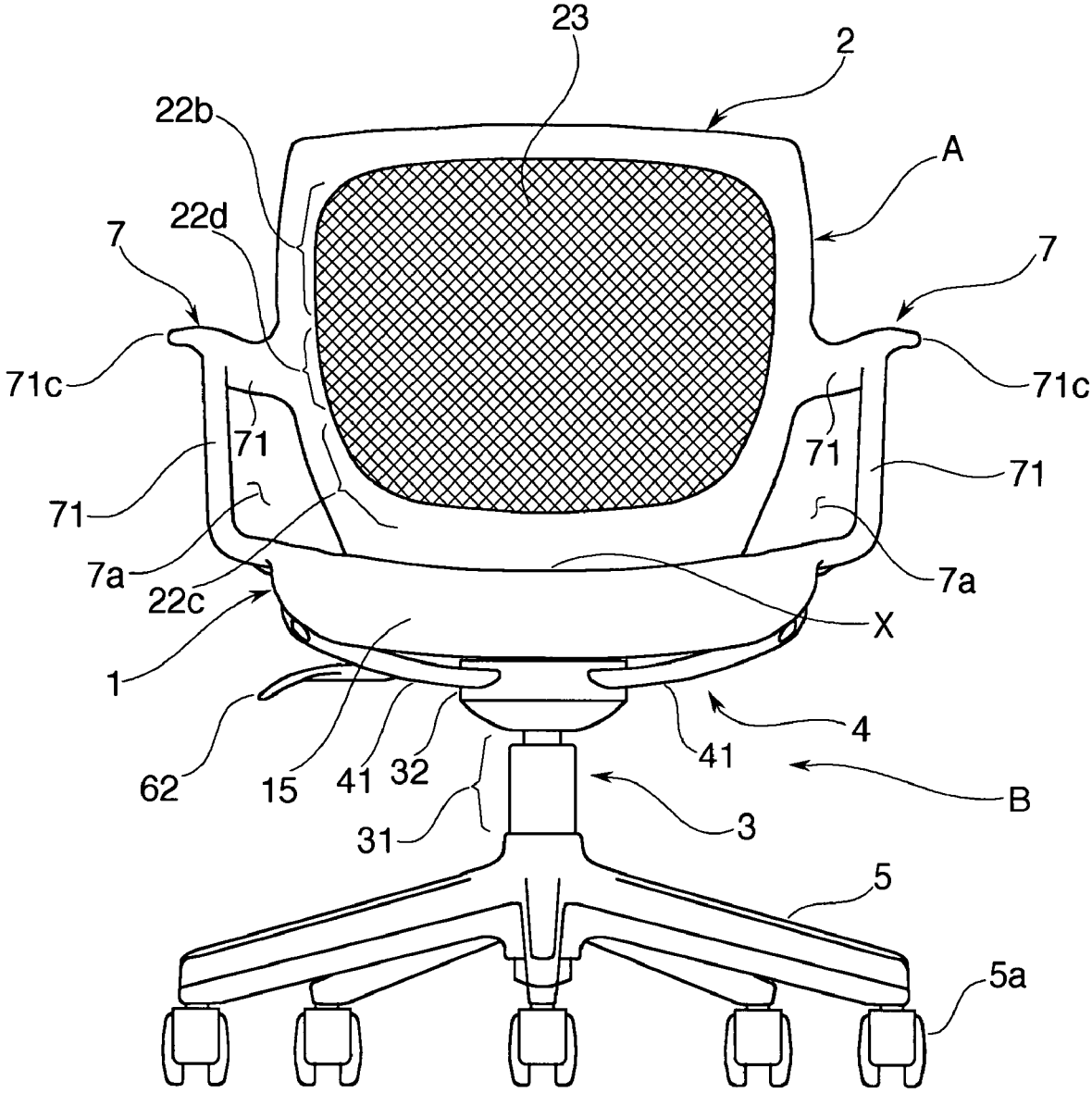
FIG. 2 is a front view thereof.
Figure 3:
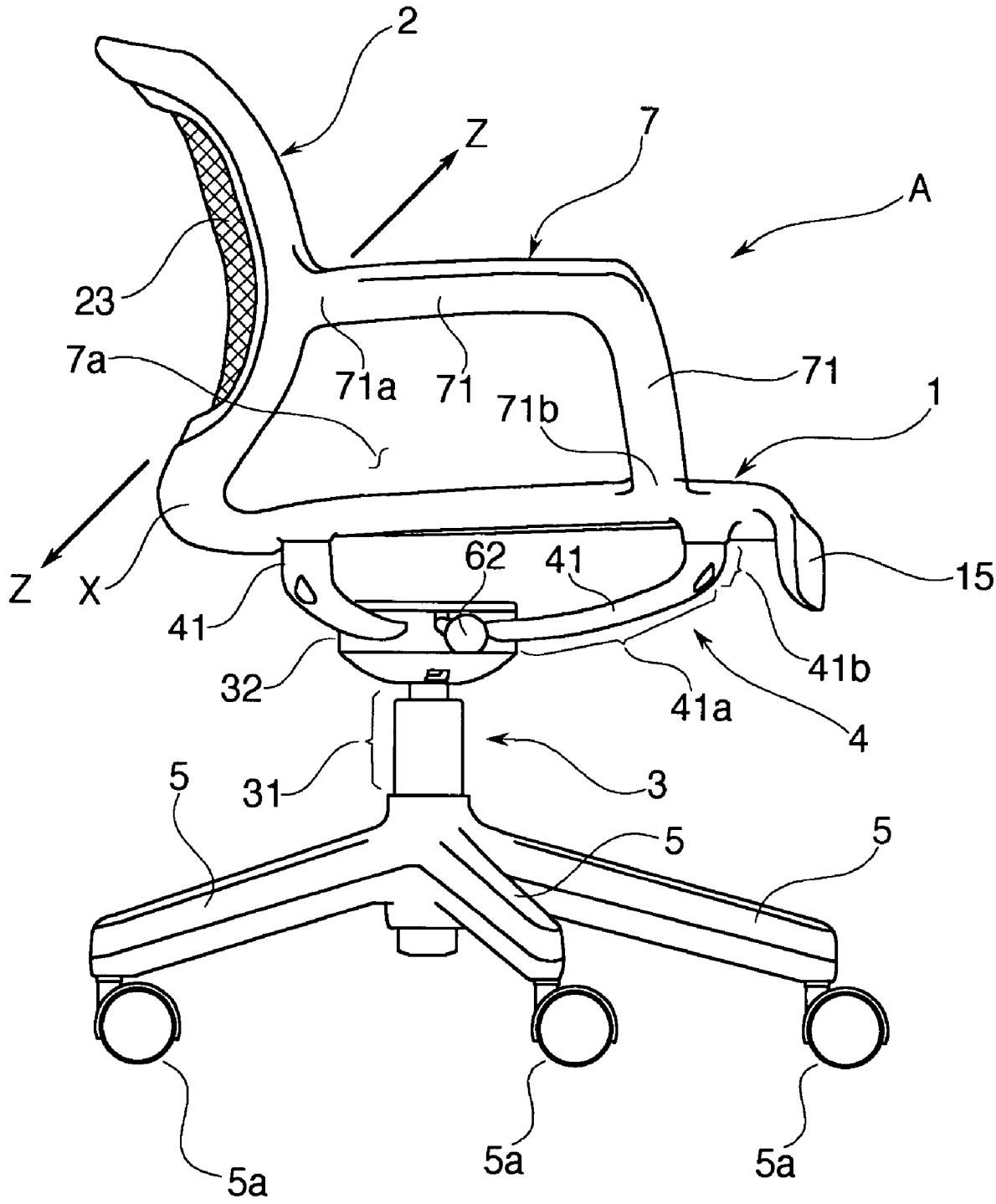
FIG. 3 is a left side view thereof.

As shown in FIG. 1 through FIG. 3, a chair of this embodiment has an arrangement wherein a chair body A comprising a seat 1, a back 2 and an armrest 7 is supported by a seat support structure 4 rising from a leg body B.

Figure 4:
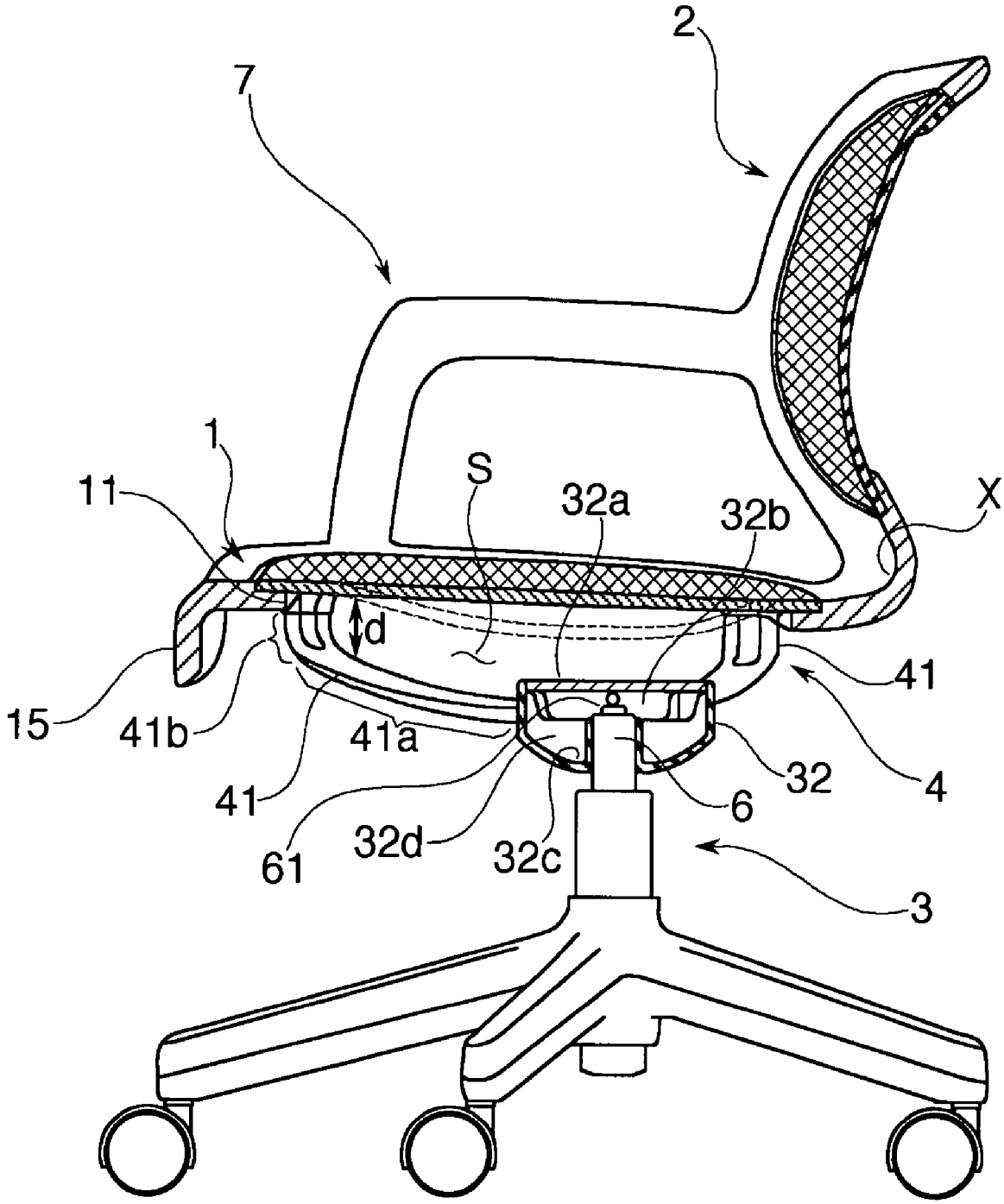
FIG. 4 is a longitudinal cross-sectional view thereof.
Figure 5:
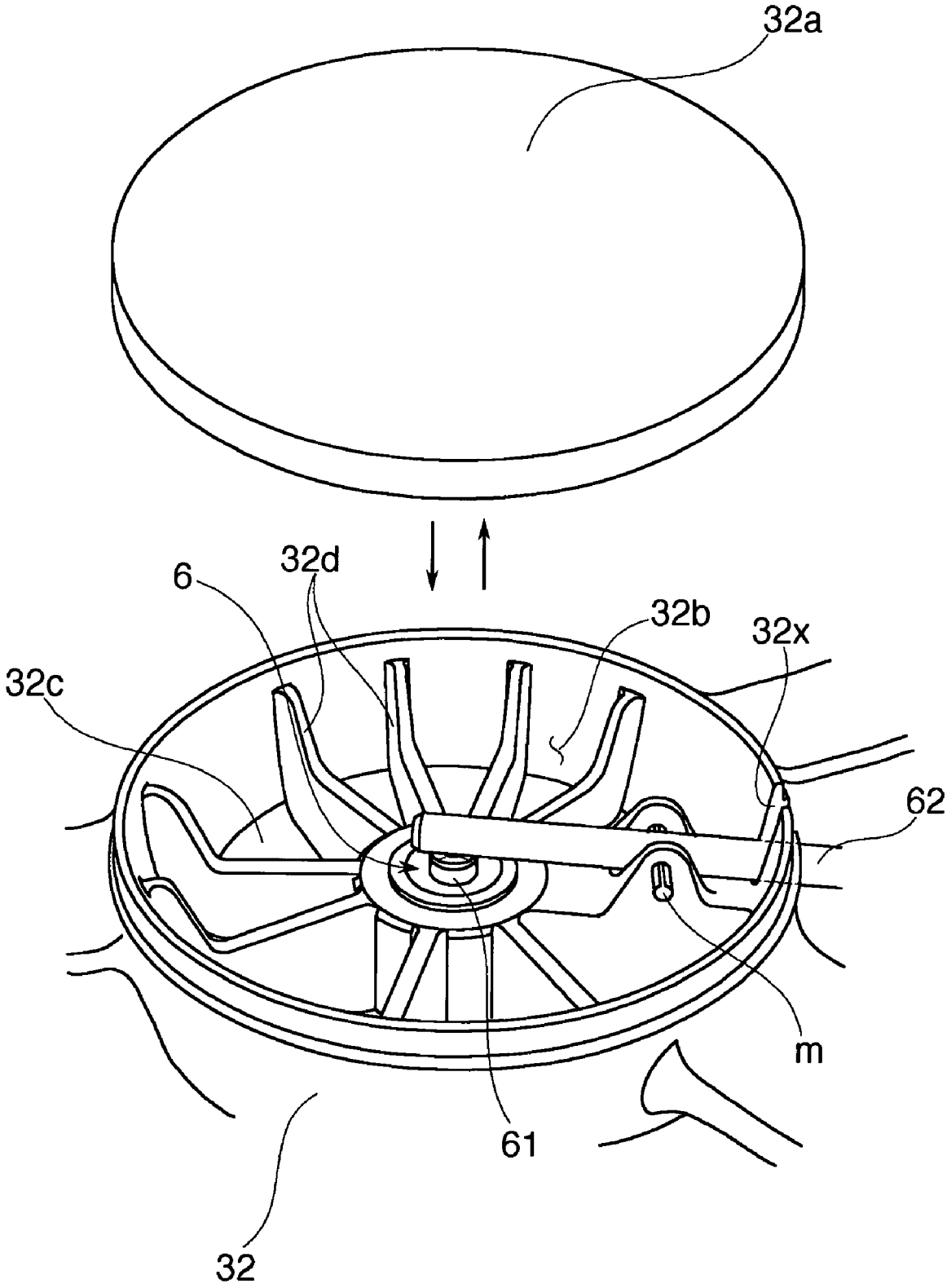
FIG. 5 is a perspective view showing an internal structure of a diameter expanding base part in accordance with this embodiment.

More specifically, the leg body B is so arranged that a leg support post 3 is rotatably supported by a center part of equiangularly radiating five blades 5 each of which has a caster 5*a* at its distal end. The leg support post 3 comprises a support body 31 and a diameter expanding base part 32 arranged at an upper end of the support body 31, and an elevating mechanism 6 of a gas spring as shown in FIG. 4 is incorporated into a part ranging from the support body 31 to the diameter expanding base part 32. The diameter expanding base part 32 comprises, as shown in FIG. 4 and FIG. 5, a cover 32*a*, a bowl-shaped void 32*b* that opens upward when the cover 32*a* is removed, a bottom wall 32*c* and a rib 32*d* that radially extends upward from a center of the bottom wall 32*c*, and an inner space is formed above the rib 32*d* so that a finger or a hand can be inserted into the void 32*b*. A working portion 61 that locks or unlocks the elevating mechanism 6 with a projecting or retrojecting movement is accommodated at a center of the diameter expanding base part 32, an operating lever 62 as being an operating part is projected toward a radial direction at a position where the working portion 61 makes an up and down movement through a cutout 32*x* arranged at a part of the diameter expanding base part 32 and mounted in a pivoted manner on a supporting axis m so as to make an up and down movement around the supporting axis m. The cover 32*a* covers the void 32*b* including the working portion 61 in a state wherein the cover 32*a* does not interfere with the operating lever 62. An operation of lifting the operating lever 62 makes the working portion 61 retroject, which frees the elevating mechanism 6 and an operation of releasing the operation of lifting makes the working portion 61 project, which locks the elevating mechanism 6.

Figure 6:
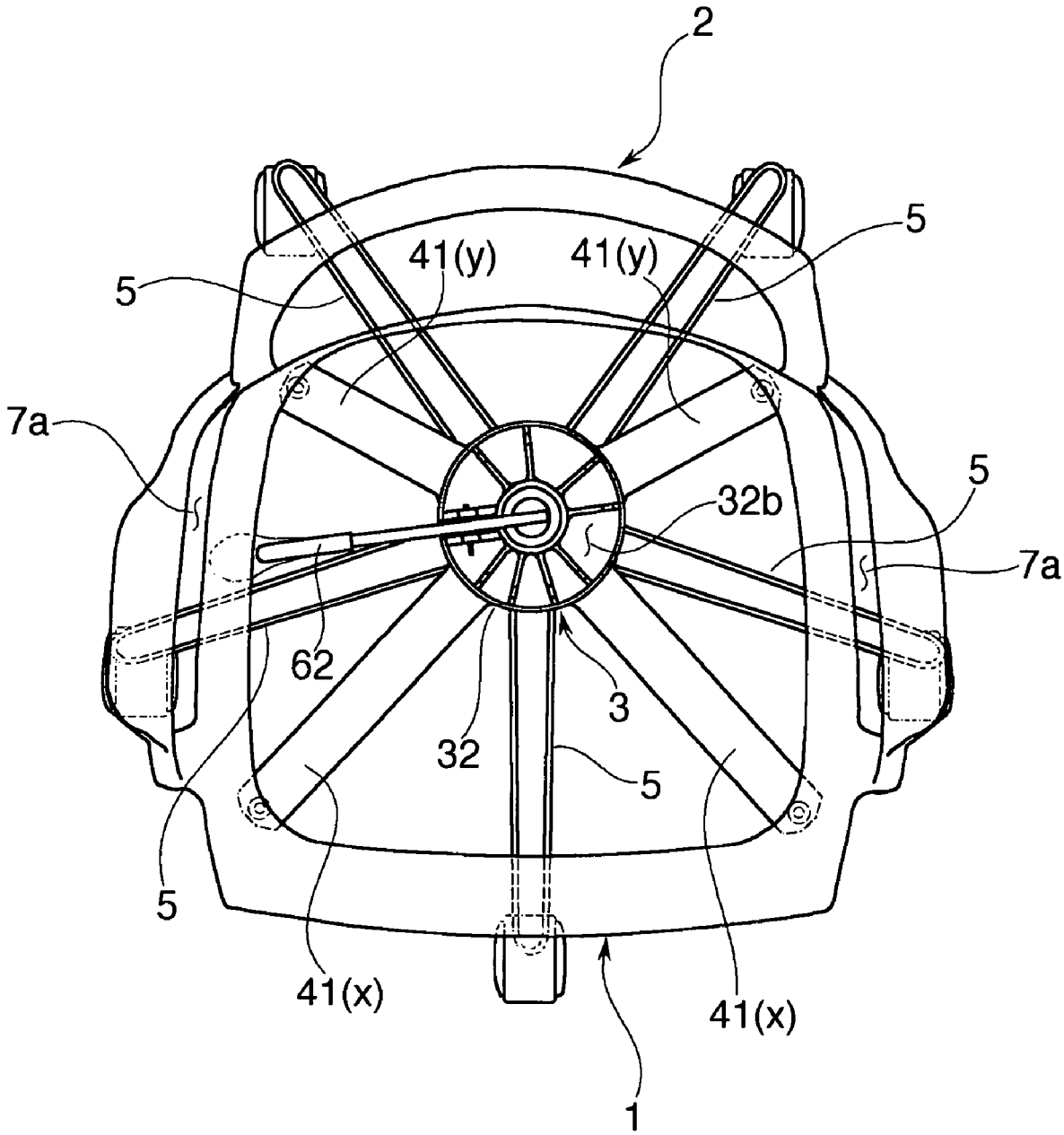
FIG. 6 is a plan view of the chair in accordance with this embodiment in a state that a mesh member is omitted to show and an upper end cover of a leg support post is removed.
Figure 7:
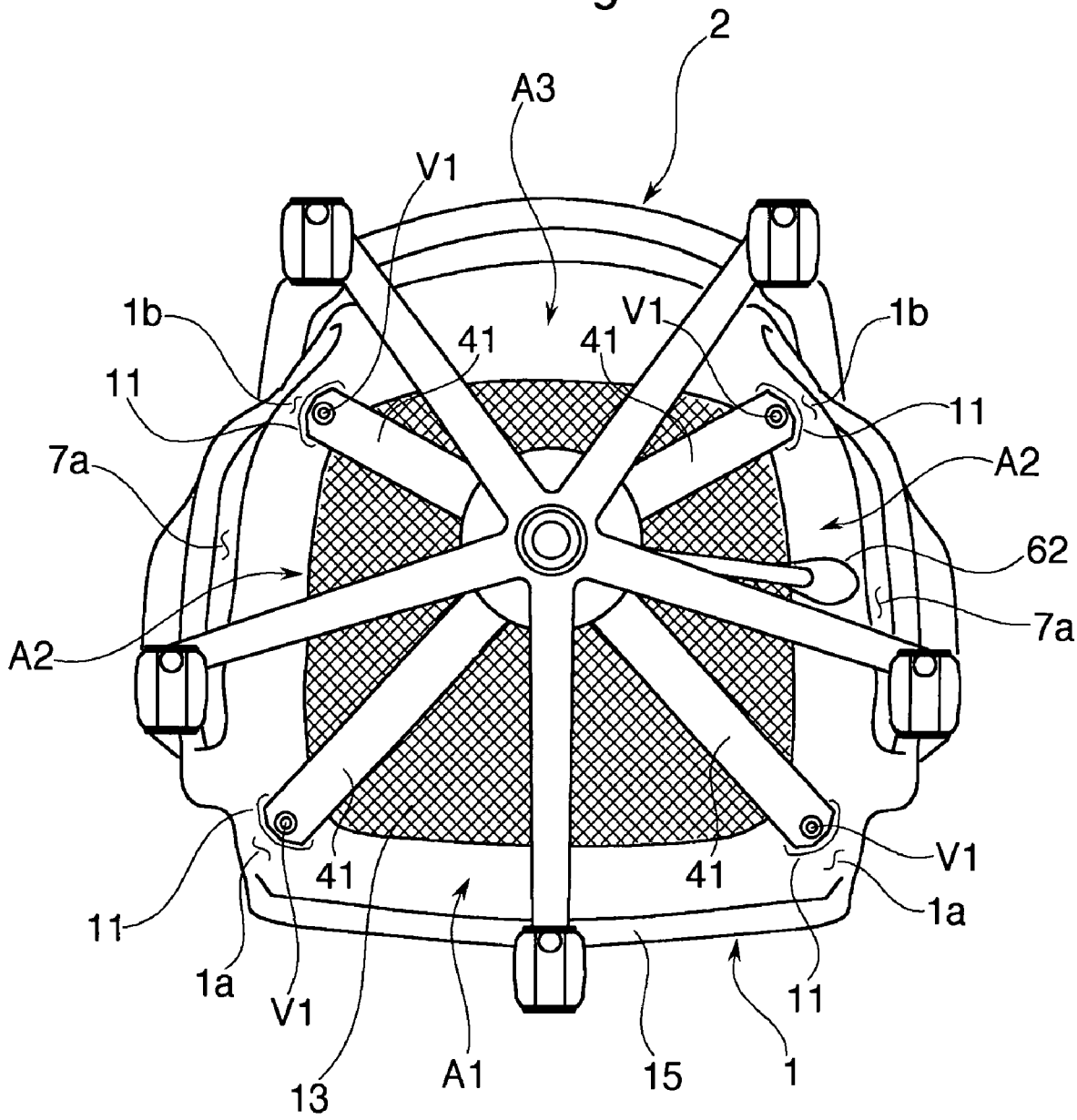
FIG. 7 is a bottom view of the chair in accordance with this embodiment.
Figure 8:
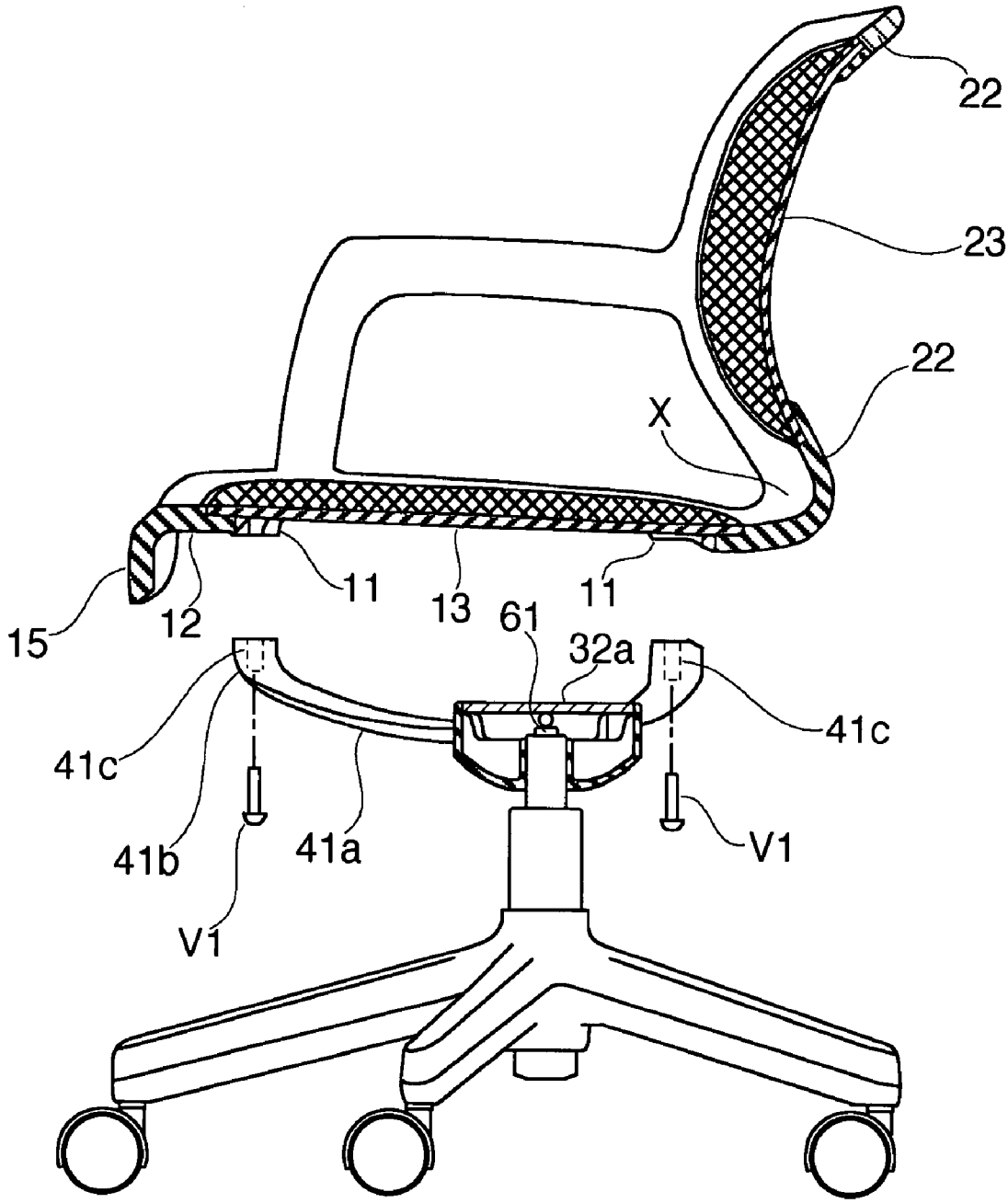
FIG. 8 is an exploded view of FIG. 4.

Four seat support frames 41 constituting the seat support structure 4 extend upward from the leg support post 3 and each distal end of the seat support frames 41 supports the seat 1. The seat support frame 41 comprises a horizontal part 41*a* and a vertical part 41*b* each of which is integrally formed, wherein a proximal end of the horizontal part 41*a* is connected to a side face of the diameter expanding base part 32 and the proximal end of the horizontal part 41*a* extends toward a side direction to be separated from a center part of the leg support post 3 with gradually bending upward, in other words, extends radially from the leg support post 3 as shown in FIG. 6 viewed on a plan view. A load from the above on the seat 1 applies to the rear of the center of the seat 1. Since the leg support post 3 locates in compliance with this, two front seat support frames 41(*x*) of four seat support frames 41 extending from the leg support post 3 to four corners of the seat 1 are set to be longer than two rear seat support frames 41(*y*). The vertical part 41*b* is, as shown in FIG. 4, smoothly connected to the horizontal part 41*a* and a distal end of the vertical part 41*b* supports an edge part of the seat 1, more concretely, each of under surfaces 1*a*, 1*b* at the four corners of the seat 1 as shown in FIG. 7. A screw inserting part 41*c* is arranged at an inner portion of the vertical part 41*b* along a vertical direction as shown in FIG. 8, and the screw inserting part 41*c* opens downward at a portion where the horizontal part 41*a* crosses the vertical part 41*b*. A cross-sectional view of the seat support frame 41 is of a flat oval shape whose size is so far forth as an adult with an average build can just grasp at an arbitrary position along the extending direction.

As mentioned above, since the seat support frames 41 radially extend to the four corners of the seat 1, portions locating below the seat 1 and locating between each of the mutually adjacent seat support frames 41, 41, more concretely, areas A1, A2, A2, A3 of a general triangle shape viewed from the bottom, each of which locates at a front of below the seat 1, right and left sides of below the seat 1, and a back of below the seat 1 respectively are open spaces where no frame exists. In this embodiment, the areas are set to be function adjusting spaces where the operating part is arranged (hereinafter the same codes A1, A2, A2, A3 as those of the above-mentioned areas are given to the function adjusting spaces) and the operating lever 62 is arranged in the function adjusting space A2 locating at the right side of below the seat 1 viewed from a seated position.

Figure 9:
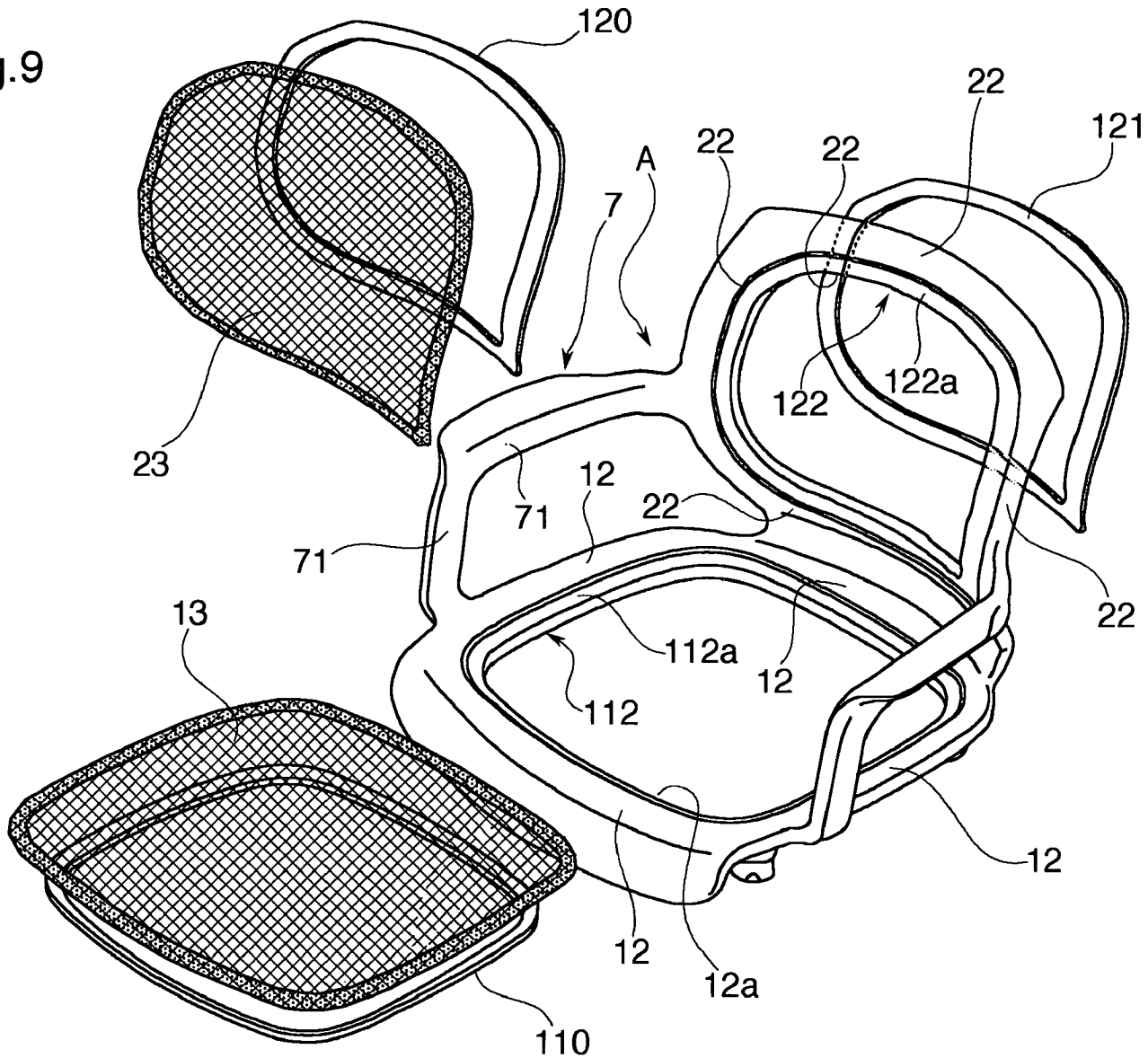
FIG. 9 is an exploded perspective view of the chair in accordance with this embodiment.

The chair body A comprises, as shown in FIG. 1, FIG. 3 and FIG. 9, the seat 1, the back 2 and the arm rest 7, and supported by the seat support structure 4 without using a back support rod, wherein a screw fastening part 11 into which a nut member is inserted as shown in FIG. 7 and FIG. 8 is arranged to hang at a position corresponding to each seat support frames 41 on the undersurface of the seat 1. The seat 1 is mounted on the seat support frames 41 by placing the seat 1 on each of the upper ends of the seat support frames 41 and then fastening a screw V1 inserted upward from beneath into the screw inserting part 41*c* of the seat support frame 41 until the screw V1 reaches the screw fastening part 11 arranged on the seat 1.

More specifically, this chair has an arrangement wherein each of the distal end parts of the seat support frames 41 constituting the seat support structure 4 is connected by each side of the seat frame 12 so as to form a frame structure three-dimensionally closed by the seat support frames 41 and the seat frame 12. This arrangement makes it possible to secure the strength of the chair as a whole so as not to be transformed due to impact or weight at a time of being seated even though the seat support frames 41 and the seat frame 12 are formed relatively thin.

As shown in FIG. 1 and FIG. 9, the seat 1 is so arranged that an opening 12*a* of inside the seat frame 12 is covered with tension by a mesh member 13 and the back 2 is so arranged that an opening 22*a* of inside the back frame 22 is covered with tension by a mesh member 23. A longitudinal rib arranged at a position to reinforce between the seat frame 12 and the back frame 22 is formed to extend toward a side direction significantly so that it can be used as the arm frame 71 so as to be the arm rest 7. Then the seat frame 12, the back frame 22 and the arm frame 71 are made of resin and integrally formed three-dimensionally.

More concretely, as shown in FIG. 1 and FIG. 2, the valid supporting part 22*b* that warps upward from a lumbar corresponding part 22*d* most projecting forward of the back frame 22 and the seat frame 12 are set to have generally the same width, a hip corresponding part 22*c* locating at a portion recessed along downward is gradually narrowed along downward, and a width of a boundary part X between the seat 1 and the back 2 is set to be smaller than a width of the valid supporting part 22*b* of the back frame 22 and a width of the seat frame 12. A rear end 71*a* of the arm frame 71 is formed to extend to a front side direction from the back frame 22 and a front end 71*b* of the arm frame 71 is formed to extend to an upper side direction from the seat frame 12, and then a peripheral border of an opening 7*a* formed by the arm frame 71, the seat frame 12 and the back frame 22 is formed in a curved shape not two-dimensionally but three-dimensionally, and whole of the arm frame, the seat frame and the back frame is integrally made of resin. More specifically, the opening 7*a* can be seen from not only a side view of FIG. 3 but also a front view of FIG. 2, a plan view of FIG. 6 and a bottom view of FIG. 7. The boundary part X between the seat 1 and the back 2 is, as shown in FIG. 8, of a continuous three-dimensional shape with a shape of a U-character whose opening faces forward in a longitudinal sectional view and its longitudinal sectional view forming a concave shape whose opening faces forward in a plain plan view and curving gently along a hip of a seated person. In addition, a front hanging part 15 is arranged at a front end of the seat 1. The front hanging part 15 is continuously arranged to the seat 1 to form a general reverse L-character in a longitudinal sectional shape as shown in FIG. 4 and its longitudinal sectional view forms a continuous three-dimensional shape with curving gently and projecting toward the front in a bottom view.

As shown in FIG. 1 and FIG. 2, the rear end 71*a* of the arm frame 7 is placed at generally the same height as that of the lumbar corresponding part 22*d* so that the rear end 71*a* is continuous to an end of the back frame 22, the back 2 is curved to form a concave shape facing the front in a plan view and the end of the back frame 22 faces the front side direction. Then the rear end 71*a* of the arm frame 7 also is formed to extend forward with making a gentle curve after extending toward the front side direction from the back frame 22. In addition, the front end 71*b* of the arm frame 71 is placed to be continuous to an end of the seat frame 12, the seat frame 12 is of a concave shape facing upward slightly in a front view and an end of the seat frame 12 faces toward upward and side direction slightly from a horizontal line. Then the front end 71*b* of the arm frame 71 also is formed to rise upward with making a gentle curve after extending from the seat frame 12 toward upward and side direction slightly from the horizontal line. Both a portion that extends to a front side direction from the back frame 22 and a portion that rises from the seat frame 12 are continuous to each of the upper ends of the arm frame 71 that horizontally extends back and forth. These arm frames 71 serve as a longitudinal rib for both the seat frame 12 and the back frame 22 from a viewpoint of a rib. And a horizontal part 71*c* is smoothly folded to be continuous to the upper end of the arm frame 71. A direction to break a master block in forming the chair body A is set as a direction of 45 degrees as being a general intermediate angle between the back and forth direction and the up and down direction (an arrow Z in FIG. 3).

As shown in FIG. 1 and FIG. 9, the mesh member 13, 23 as being another member to form a seating face is fitted into the opening 12*a*, 22*a* each of which exists inside the seat frame 12 or inside the back frame 22 through a mounting frame 110 or 120.

Figure 10:
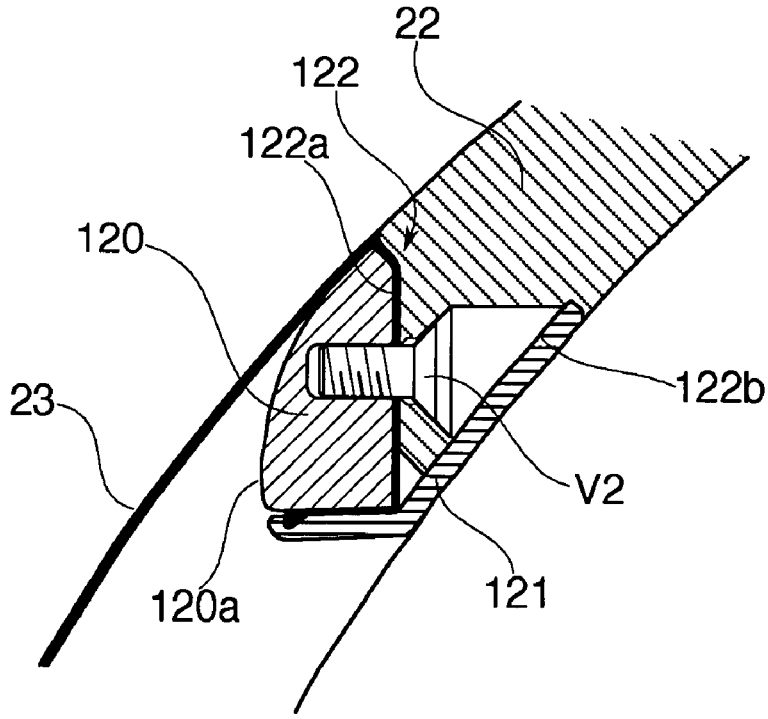
FIG. 10 is a cross-sectional view showing a state that the mesh member is fitted into an opening of the back frame.

As shown in FIG. 9 and FIG. 10, at an opening edge of the back frame 22 arranged is a frame member mounting part 122. At a front face of the frame member mounting part 122 provided is a frame member mounting face 122*a* and at its back face provided is a groove 122*b* into which a plate shaped body is fitted. The mounting frame 120 in which the mesh member 23 is entangled is fitted into the front face of the frame member mounting part 122, and the mounting frame 120 is fastened with a screw V2 that is inserted into the frame member mounting part 122 of the back frame 22 from its back face, and then a decorative frame 121 is fitted into a position to cover the screw V2. On the mounting frame 120 formed is a supporting face 120*a* that bows toward a direction to gradually narrow its opening width with the mesh member 23 receiving a load.

Figure 11:
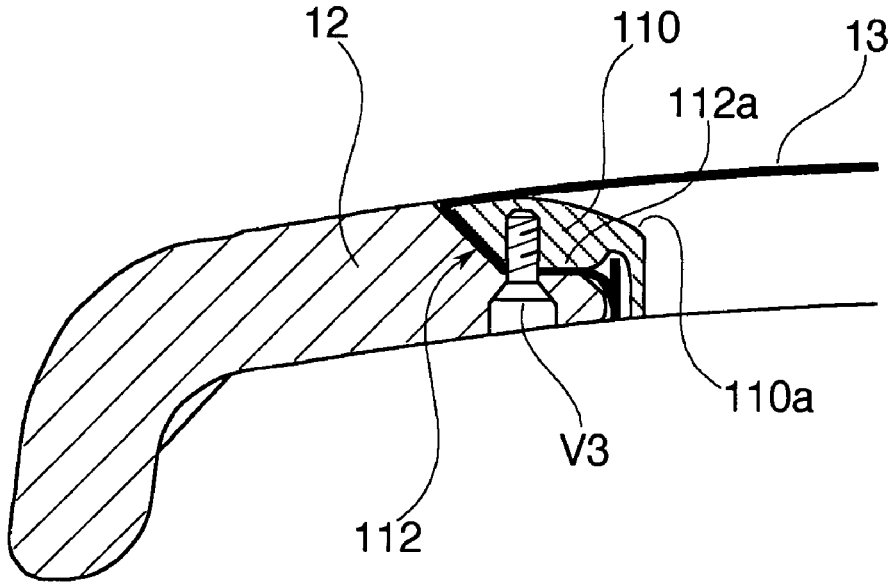
FIG. 11 is a cross-sectional view showing a state that the mesh member is fitted into an opening of the seat frame.

In addition, as shown in FIG. 9 and FIG. 11, a frame member mounting part 112 having a frame member mounting face 112*a* at its upper face is arranged at an opening edge of the seat frame 12, the mounting frame 110 in which the mesh member 13 is entangled is fitted into an upper face of the frame member mounting part 112, and a screw V3 that is inserted into the seat frame 12 from its bottom face is fastened with the mounting frame 110. On the mounting frame 110 formed is a supporting face 110*a* that bows toward a direction to gradually narrow its opening width with the mesh member 13 receiving a load.

As mentioned above, this embodiment forms the chair shown in FIG. 1 and a three-dimensional space S is formed at least between the upper end of the leg support post 3 and the seat 1 wherein a dimension d is a sum of a length of the vertical part 41*b* of the seat support frame 41 and a length of the screw fastening part 11 that hangs from the seat frame 12 as shown in FIG. 4 and FIG. 8, which allows the seat 1 to sink into the space S with bowing as shown by a broken line in FIG. 4 due to the load applied to the seat 1 from the above. A size of the space S is so set that an operator can mount or dismount the cover 32*a* by inserting his or her hand and fingers and a tool, if necessary, at least at a time when no one sits on this chair, and the seat support structure 4 is a frame structure comprising the seat support frames 41. As a result, it is possible to mount or dismount the cover 32*a* by accessing the hand and fingers from any direction of both the back and front, and the right and left to the space S and to conduct maintenance of the internal working portion 61.

In addition, this chair has an arrangement that the seat support structure 4 locating below the seat 1 has multiple seat support frames 41, the working portion 61 is arranged at the center of the seat support structure 4 and the seat 1 is placed on the seat support frames 41 and fixed to the seat support frames 41 by means of the screws V1 only. As a result, maintenance of the working part 61 can be conducted, if necessary, by exposing the working portion 61 with procedures of separating the seat 1 from the seat support structure 4 by unfastening the screws V1 as shown in FIG. 8 and of dismounting the cover 32*a*. Since the seat 1 is fixed to each of the seat support frames 41 at four points with the screws V1 as shown in FIG. 7, the seat 1 can be swirled horizontally to the seat support structure 4 with its distal end of each seat support frame 41 kept at generally the same height as shown in FIG. 4 and FIG. 8, at a time when the three screws V1 are unfastened, which also enables to expose the working portion 61. In this case, since the seat 1 is horizontally held by an appropriate seat support frame 41 of the seat support structure 4 at a position after the seat 1 is swirled, maintenance of the working portion 61 can be conducted without holding the seat 1 by hand.

Figure 12:
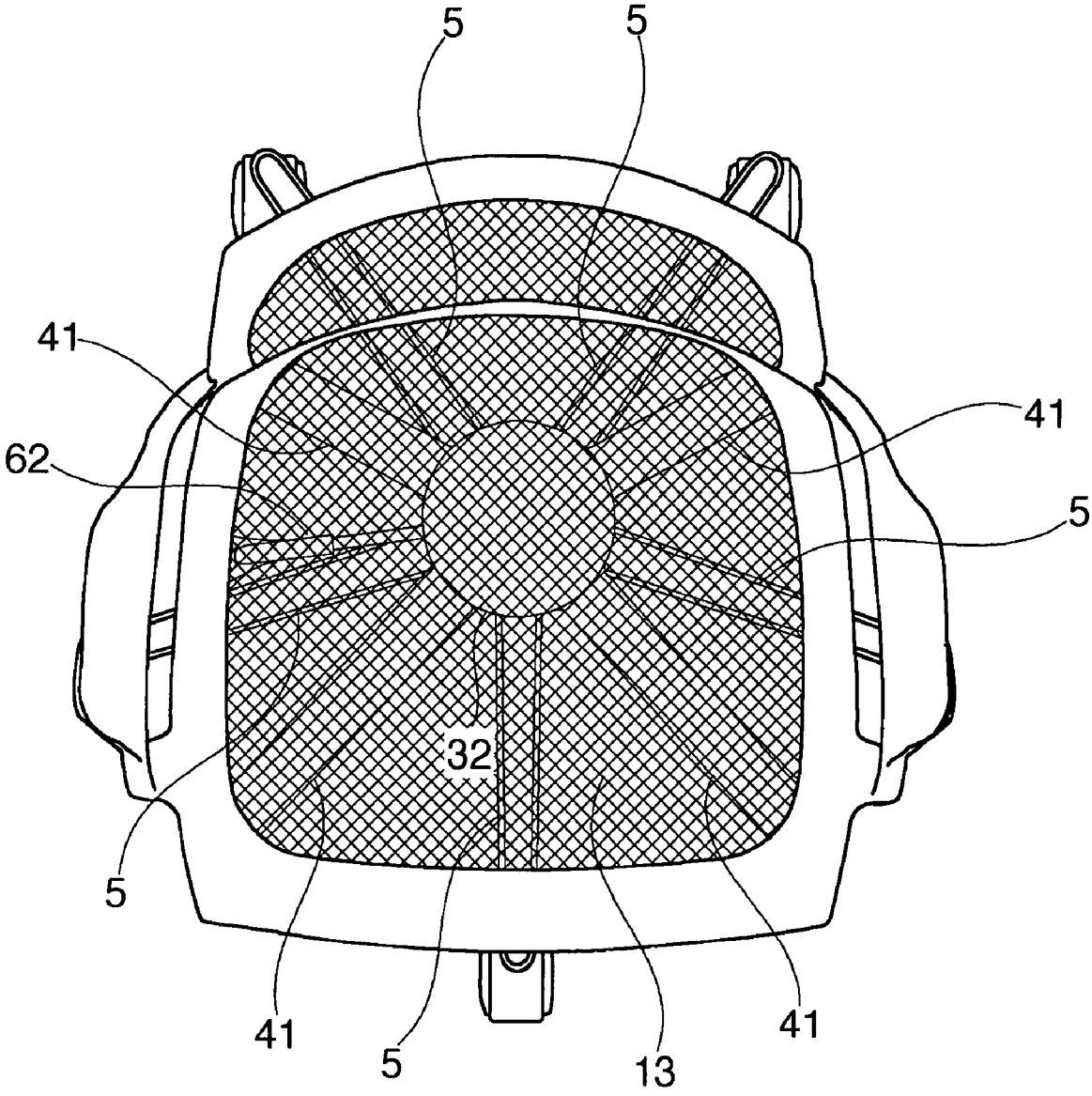
FIG. 12 is a plan view of the chair in accordance with this embodiment.

If this chair is viewed from a visual point of view, the mesh member 13 set up with tension inside the seat frame 12 forms a translucent area with neither a seat frame of a block shape nor a shell arranged under the mesh member 13, and a silhouette of the seat support frames 41 constituting the seat support structure 4 and the blades 5 equiangularly radiating from the proximal portion of the seat support frames 41 can be seen on the seating face as shown in FIG. 12.

As mentioned above, if the inside of the seat frame 12 is the translucent area, not only a position of the operating part and a number thereof but also a general picture of its function can be visible from the above shown in FIG. 12 in case the operating part is arranged in the function adjusting space A1 through A3 in FIG. 7. In this embodiment, the operating lever 62 of the elevating mechanism 6 alone is arranged in the function adjusting space A2 locating at a lower right position when seated. As a result, it is easily visible that the operating lever 62 is arranged at one position alone, the operating lever 62 locates at the lower right position when seated, the operating lever 62 extends radially from the upper end of the leg support post 3 and the operating lever 62 is to operate the elevating mechanism 6 of a gas spring type. In addition, if an operating part locates in the other function adjusting space A1, A3 shown in FIG. 7, this operating part also can be visible from the above in FIG. 12. This arrangement makes it possible to easily visualize a number of the operating parts, a position thereof, a kind of function thereof or a way to operate the operating parts by making use of its silhouette.

As mentioned above, the chair body A in accordance with this embodiment comprises the seat frame 12, the back frame 22 and the rib that reinforces between the seat frame 12 and the back frame 22, and the chair body A is not supported by a back support rod. Then the rib is formed to extend toward a side direction so as to be used as an arm frame 71, and the seat frame 12, the back frame 22 and the arm frame 71 are continuously and integrally formed three-dimensionally, and the opening 12*a*, 22*a* into which the mesh member 13, 23 as the another member to form the seating face is fitted is arranged at the seat frame 12 and the back frame 22 respectively.

More specifically, for a conventional frame structure with the back and the seat separately arranged, or a conventional frame structure with only the back and the seat integrally formed, a load is applied to a joint or a load is applied only to a single portion, which might cause the joint unjointed, or a crack. However, in accordance with this embodiment, since the seat frame 12, the back frame 22 and the arm frame 71 are integrally formed, a load applied to the chair body A can be dispersed and reduced. Especially, since the opening 12*a*, 22*a* is formed for the back frame 22 and the seat frame 12 respectively, a part of the frame locates at the boundary part X between the seat 1 and the back 2 as being the boundary between the opening 12*a* and the opening 22*a* and each opening 12*a*, 22*a* can be covered with tension by the mesh member 13, 23 as being the another member, a required strength can be easily secured. Especially since generally whole of the arm frame 71 serves as a longitudinal rib that is generally vertical to the seating face and the back rest face, it becomes more effective to serve as a function of securing the strength.

More concretely, the width of the valid supporting part 22*b* locating above the lumbar corresponding part 22*d* of the back frame 22 is generally the same as the width of the seat frame 12, the hip corresponding part 22*c* locating below the lumbar corresponding part 22*d* of the back frame 22 is gradually narrowed along downward, and the width of the boundary part X between the seat 1 and the back 2 is set to be smaller than the width of the valid supporting part 22*b* of the back 2 and the width of the seat frame 12, the rear end of the arm frame 71 is formed to extend to the front side direction from the back frame 22 and the front end of the arm frame 71 is formed to extend to the upper side direction from the seat frame 12 and then the peripheral border of an opening 7*a* formed by the arm frame 71, the seat frame 12 and the back frame 22 is formed in a curved shape not two-dimensionally but three-dimensionally, and whole of the arm frame, the seat frame and the back frame is integrally made of resin.

As mentioned, with an arrangement wherein the arm frame 71, the seat frame 12 and the back frame 22 are three-dimensionally continuous, a stress can be dispersed effectively. As a result of this, it is possible to effectively secure strength as a structure of the chair as well as an amount of the resin to be used can be reduced as much as possible.

In addition, since the boundary part X between the seat 1 and the back 2 is of a shape of a U-character whose opening faces forward in a longitudinal sectional view and its longitudinal sectional view forms a continuous three-dimensional shape with curving gently along a hip of a seated person in a plan view, it is possible to effectively improve strength of the boundary part X where stress is easily concentrated with taking a form along a body of a seated person. More specifically, since the boundary part X is of the shape of a U-character, a distal end opening of the U-character shape is difficult to be further opened. In addition, since the U-character shape is curved in the plan view, a force toward a direction to open the opening of the U-character shape is difficult to be concentrated on the U-character shape compared with a case wherein a U-character shape is arranged on a straight line in a plan view, thereby to assure the strength more effectively.

Furthermore, since the front hanging part 15 is arranged at the front end of the seat 1, the front hanging part 15 is of a general reverse L-character in a longitudinal sectional shape, and its longitudinal sectional view forms a continuous three-dimensional shape with gently curving along the front edge of the seat 1, the front hanging part 15 of the three-dimensional shape arranged at the front end of the seat 1 contributes to assuring the strength of the seat 1 when a big load is applied to the front end of the seat 1, and a more stable seating state can be assured when a person sits on the chair because the front hanging part 15 supports a portion ranging from a back side of the knee to the calves of the seated person from behind. Especially, since the front hanging part 15 is curved in a plan view, an angle of the L-character is difficult to open compared with a case wherein a front hanging part 15 is linear in a plan view, thereby to improve the strength.

The arm frame 71 serves as a rib by connecting the seat frame 12 and the back frame 22. In addition, since the arm frame 71 has the horizontal part 71*c* that is folded toward a direction orthogonal to the direction connecting the seat frame 12 and the back frame 22, the arm frame 71 is difficult to bend compared with an arm frame without a horizontal part, and the horizontal part 71*c* assures an enough area where an arm of a seated person contacts.

In addition, since the arm frame 71 has such a configuration that the end thereof is continuous to the end of the seat frame 12 and extends to the side direction from the seat frame 12 and then smoothly rises upward, it is possible to avoid stress concentrated on the portion connecting the seat frame 12 and the arm frame 71, thereby to effectively prevent unjoint of the connecting portion and crack. This arrangement of no joint also contributes to a smooth appearance. In addition, an arrangement that the arm frame 71 extends to the side direction and then smoothly rises upward generates a margin that enables the seated person to move from side to side to protrude from the seating face to a certain degree with dispersing the stress, which makes it possible for the seated person to take a seating posture with greater freedom.

Furthermore, since the arm frame 71 has such a configuration that the end thereof is continuous to the end of the back frame 22 and then extends to the front side direction from the back frame 22 with forming a smooth curve, it is possible to avoid stress concentrated also on the portion connecting the back frame 22 and the arm frame 71, thereby to effectively prevent unjoint of the connecting portion and crack. This arrangement of no joint also contributes to a smooth appearance. In addition, an arrangement that the arm frame 71 extends to the front side direction with forming a smooth curve generates a margin that enables the seated person to move from side to side to protrude from the backrest face to a certain degree with dispersing the stress, which makes it possible for the seated person to take a seating posture with greater freedom.

The rear end 71*a* of the arm frame 71 is connected to the back frame 22 at the lumbar corresponding part 22*d* most protruding forward among a back rest supporting face. Since the lumbar corresponding part 22*d* is a portion to which a backrest load applies the most, it is possible to improve the strength of the lumbar corresponding part 22*d* by connecting the rear end 71*a* of the arm frame 71 with the lumbar corresponding part 22*d*.

Especially, in this embodiment, since the another member comprises a mesh member 13, 23 and a supporting face 110*a*, 120*a* having a curved surface that supports the mesh member 13, 23 is arranged at an edge of the opening 12*a*, 22*a* and when the mesh member 13, 23 receives a load, the curved surface supports the load through the mesh member 13, 23 with the mesh member 13, 23 smoothly bowing along the curved surface, it is possible to obtain an assured supporting state along deflection with avoiding a load applied locally. In addition, with an arrangement that the supporting face 110*a*, 120*a* is fixed, the mesh member 13, 23 serves as a reinforcement of the seat frame 12 or the back frame 22 more effectively compared with a case of having a movable supporting face.

Furthermore, since the corner portions 1*a*, 1*a*, 1*b*, 1*b* of the seat frame 12 are rotatably supported by the leg support post 3 through the multiple seat support frames 41 that extend radially, it is possible to effectively avoid deformation of the seat frame 12. In addition, this arrangement makes it possible to effectively serve as a swivel chair of a type wherein a seating face is fitted into the opening 13, 23.

A concrete arrangement of each part is not limited to the above-mentioned embodiment.

For example, in the above embodiment, the seat frame 12, the back frame 12 and the arm frame 7 are integrally formed of resin, however, a seat frame component and a back frame component, each of which is separated, and an arm frame component that functions as a rib may be connected integrally by the use of connecting members. With this arrangement, each of the seat frame component and the back frame component can be considered as a closed component, certain strength can be obtained by connecting the seat frame component and the back frame component at a boundary part between the seat and the back. In addition, the arm frame component serves as a rib that connects between the seat frame component and the back frame component and the opening of the seat frame component and the opening of the back frame component are covered with tension, it is possible to effectively prevent unjoint of the portion connecting the seat frame component and the back frame component and crack.

Figure 13:
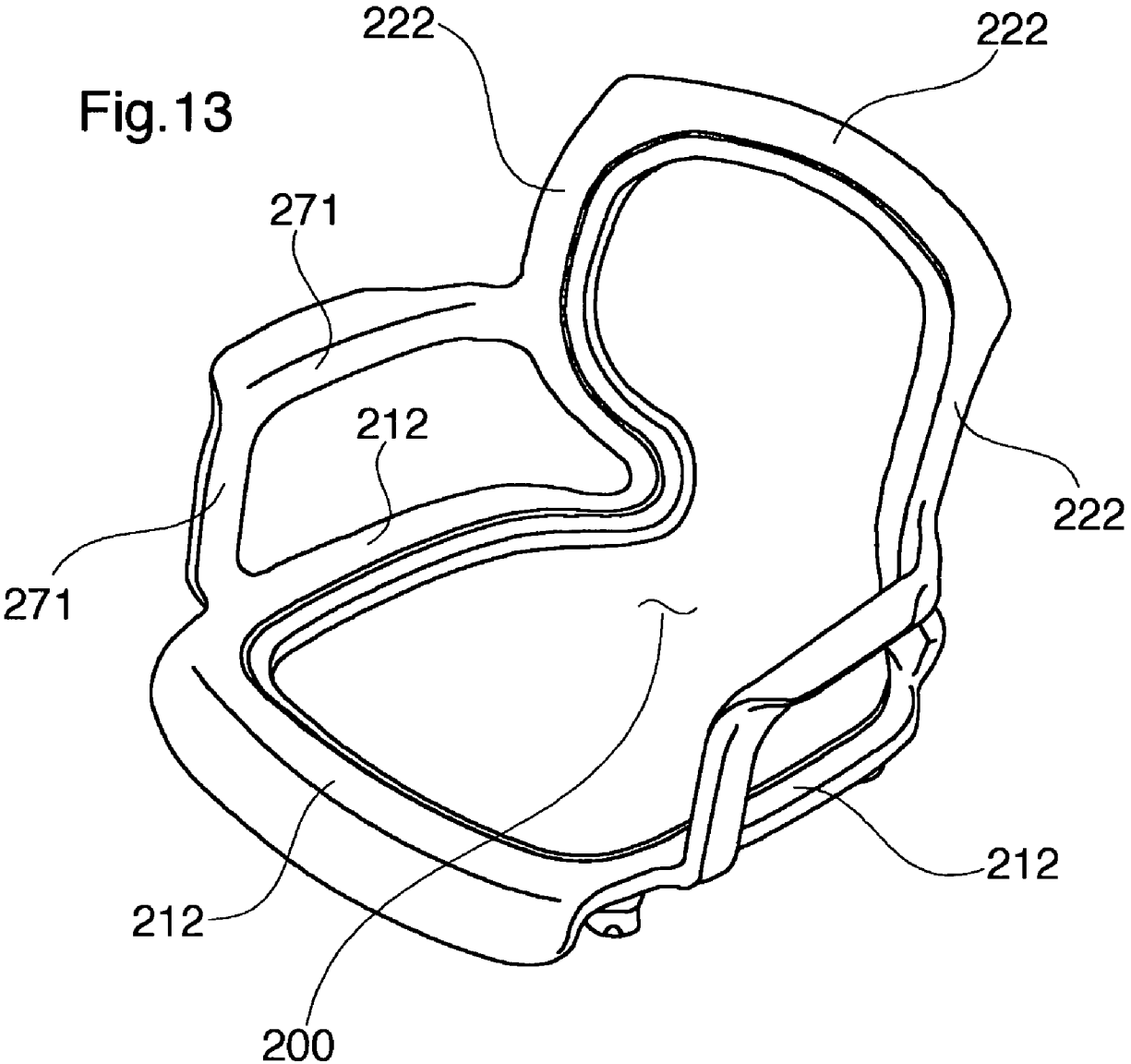
FIG. 13 is a view showing a modified form of this invention.

Furthermore, based on the premise of integral molding, as long as the rib is formed to extend toward a side direction so as to be used as the arm frame, and the seat frame, the back frame and the arm frame are integrally formed three-dimensionally, a single big opening 200 may be arranged at a portion ranging from a seat frame 212 to a back frame 222, as shown in FIG. 13, and a mesh member (omitted to show in the drawing) as being the another member to form the seating face may be fitted into the opening 200. With this arrangement also, since the seat frame 212, the back frame 222 and an arm frame 277 that connects between the seat frame 212 and the back frame 222 mutually reinforce three-dimensionally and the opening 200 at the portion ranging from a seat frame 212 to a back frame 222 is covered with tension, it is possible to effectively prevent unjoint of the connecting portion and crack.

Other arrangement may be variously modified without departing from the spirit of the invention.

For example, the seating face may be transparent or translucent made of acrylic material in stead of the mesh member. This arrangement produces the same effect visually as that of the above-mentioned embodiment.

The invention claimed is:

1. A chair, comprising:

a chair body including a seat frame, a back frame including a valid supporting part, a hip corresponding part and a lumbar corresponding part, said valid supporting part being disposed above said lumbar corresponding part, and said lumbar corresponding part being disposed above said hip corresponding part, a boundary part connecting a rear edge of said seat frame and a bottom edge of said back frame, and a pair of arm frames, each connected to said seat frame and said back frame, said arm frames extending to a side direction, wherein a width of said valid supporting part is generally the same width as said seat frame, wherein a width of said a hip corresponding part gradually narrows in the downward direction, wherein a width of said boundary part is smaller than the width of said valid supporting part and the width of said seat frame, wherein rear ends of each of said arm frames are connected to a front side of said back frame, wherein front ends of each of said arm frames are connected to an upper side of said seat frame, wherein said arm frames, said seat frame and said back frame are integrally made of resin, wherein a peripheral border of each of a pair of openings, each entirely bound by one of said arm frames, said seat frame and said back frame, is curved three-dimensionally, and wherein one end of each of said arm frames is connected to said back frame at a height generally the same as a height of said lumbar corresponding part, said lumbar corresponding part protruding forward-most among all parts of said back frame.

2. The chair described claim 1, wherein each of said back frame and seat frame include a seating face member opening, wherein a seating face member including a mesh member and a supporting face is arranged at an edge of said seating face member opening, said supporting face having a curved surface that supports said mesh member, and wherein when said mesh member receives a load, said curved surface supports the load through said mesh member with said mesh member smoothly bowing along said curved surface.

3. The chair described in claim 1, wherein said boundary part between said seat frame and said back frame has a U-shape, with an opening facing forward in a longitudinal sectional view, and wherein the longitudinal sectional view of said boundary part forms a continuous three-dimensional shape and curves gently.

4. The chair described in claim 1, wherein corner portions of said seat frame are rotatably supported by a leg support post through multiple seat support frames that extend radially.

5. The chair described in claim 1, further comprising a front hanging part arranged at a front end of said seat frame, said front hanging part having a reverse L-shape in a longitudinal sectional view, wherein the longitudinal sectional view of said front hanging part forms a continuous three-dimensional shape and curves gently along a front edge of said seat frame.

6. The chair described in claim 1, wherein each of said arm frames includes a horizontal part continuously formed in a smoothly folded manner at an upper end thereof.

7. The chair described in claim 1, wherein each of said arm frames has a configuration such that an end thereof is continuous with said seat frame, extends to a side direction from said seat frame, and then smoothly rises upward.

8. The chair described in claim 1, wherein each of said arm frames has a configuration such that an end thereof is continuous with said back frame and is connected to a front side of said back frame by a smooth curve.

9. A chair, comprising:

a chair body including a seat frame, a back frame, a pair of arm frames, each connected to said seat frame and said back frame, wherein said arm frames extend in a side direction, wherein said seat frame, said back frame and said arm frames are continuously and integrally formed three-dimensionally, wherein said chair body includes one or more seating face member openings into which one or more seating face members is fitted, wherein a peripheral border of an opening formed by one of said pair of arm frames, said seat frame and said back frame is curved three dimensionally such that the opening is visible in each of a side view, a front view, a plan view, and a bottom view of said chair body, and wherein one end of each of said arm frames is connected to said back frame at a height generally the same as a height of a lumbar corresponding part, said lumbar corresponding part protruding forward-most among all parts of said back frame.

10. A chair, comprising:

a chair body including a seat frame, a back frame, a pair of arm frames, each connected to said seat frame and said back frame, wherein said arm frames extend in a side direction, wherein said seat frame, said back frame and said arm frames are continuously and integrally formed three-dimensionally, wherein said chair body includes one or more seating face member openings into which one or more seating face members is fitted, wherein a peripheral border of an opening formed by one of said pair of arm frames, said seat frame and said back frame is curved three dimensionally such that the opening is visible in each of a side view, a front view, a plan view, and a bottom view of said chair body, and wherein corner portions of said seat frame are rotatably supported by a leg support post through multiple seat support frames that extend radially.

* * * * *